US010543965B2

(12) United States Patent
Rehders

(10) Patent No.: US 10,543,965 B2
(45) Date of Patent: Jan. 28, 2020

(54) CHILD-RESISTANT SMOKING ARTICLE PACKAGE

(71) Applicant: Fontem Holdings 1 B.V., Amsterdam (NL)

(72) Inventor: Thorben Rehders, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 83 days.

(21) Appl. No.: 15/527,544

(22) PCT Filed: Nov. 12, 2015

(86) PCT No.: PCT/EP2015/076427

§ 371 (c)(1),
(2) Date: May 17, 2017

(87) PCT Pub. No.: WO2016/079001

PCT Pub. Date: May 26, 2016

(65) Prior Publication Data

US 2017/0341829 A1 Nov. 30, 2017

(30) Foreign Application Priority Data

Nov. 18, 2014 (EP) ..... 14193625

(51) Int. Cl.
*B65D 50/04* (2006.01)
*A24F 13/14* (2006.01)
(Continued)

(52) U.S. Cl.
CPC ..... *B65D 50/04* (2013.01); *A24F 13/14* (2013.01); *B65D 43/16* (2013.01); *B65D 50/046* (2013.01);
(Continued)

(58) Field of Classification Search
CPC ..... A24F 13/14; A24F 15/18; A24F 15/12; B65D 2215/02; B65D 2215/06; B65D 50/046; B65D 85/1081; B65D 85/1045
See application file for complete search history.

(56) References Cited

U.S. PATENT DOCUMENTS 2,782,910 A * 2/1957 Leibow ..... A24F 15/18 206/259
4,048,050 A 9/1977 Hillman
(Continued)

FOREIGN PATENT DOCUMENTS

EP 2144517 B1 6/2014
FR 2429718 A1 1/1980
(Continued)

*Primary Examiner* — Mollie Impink
(74) *Attorney, Agent, or Firm* — Dykema Gossett PLLC

(57) ABSTRACT

A child-resistant smoking article package 100 is provided which comprises a case 103 with an opening 104 that is adapted to receive a smoking article 102 and a cap 107 movable between a closed state wherein the cap 107 closes the case 103 and an open state wherein the opening 104 of the case 103 is accessible. The child-resistant smoking article package 100 further comprises a first releaseably engageable fixation member 108-1 and a second and third releaseably engageable fixation member 108-2, 108-3, wherein the second and third releaseably engageable fixation members 108-2, 108-3 are arranged on opposing sides of the child-resistant smoking article package 100. The first, second and third releaseably engageable fixation members 108-1, 108-2, 108-3 are adapted to immovably fix the cap 107 to the case 103 in the closed state and to release the cap 107 when they are simultaneously actuated.

9 Claims, 14 Drawing Sheets

(51) Int. Cl.
*B65D 85/10* (2006.01)
*B65D 43/16* (2006.01)
*B65D 8/00* (2006.01)

(52) U.S. Cl.
CPC ..... *B65D 85/10* (2013.01); *B65D 15/18* (2013.01); *B65D 2215/02* (2013.01); *B65D 2215/06* (2013.01)

(56) References Cited

U.S. PATENT DOCUMENTS

| | | | | |
|---|---|---|---|---|
| 4,746,008 | A | 5/1988 | Heverly et al. | |
| 5,740,938 | A * | 4/1998 | Hofmann ..... | B65D 43/162 206/531 |
| 6,446,793 | B1 | 9/2002 | Layshock | |
| 2002/0185404 | A1 * | 12/2002 | Donegan ..... | B65D 77/02 206/531 |
| 2004/0089668 | A1 * | 5/2004 | Lambelet, Jr. ..... | B65D 43/164 220/835 |
| 2007/0034589 | A1 | 2/2007 | Zeide | |
| 2009/0255842 | A1 | 10/2009 | Brozell et al. | |
| 2013/0256163 | A1 | 10/2013 | Cottle et al. | |

FOREIGN PATENT DOCUMENTS

| | | | |
|---|---|---|---|
| WO | 2005/123526 | A2 | 12/2005 |
| WO | 2007065240 | A1 | 6/2007 |
| WO | 2012053964 | A1 | 4/2012 |

* cited by examiner

CHILD-RESISTANT SMOKING ARTICLE PACKAGE

CROSS-REFERENCE TO RELATED APPLICATION

This application is a National Stage Entry application of International patent application no. PCT/EP2015/076427 (the '427 application), filed 12 Nov. 2015 and published under International publication no. WO/2016/079001 A1 on 26 May 2016. This application claims priority to European patent application no. 14193625.2 (the '25.2 application), filed 18 Nov. 2017; now European patent no. EP3023015, granted 24 Oct. 2018. The '427 application and the '25.2 application are both hereby incorporated by reference as though fully set forth herein.

Child-resistant packages are well known in the field of medicaments. The regulations for a package to be declared "child-resistant" or "child-safe" are defined by different international norms and standards. These regulations require that a package would have to successfully undergo a number of tests with actual groups of children in order to be officially declared child-resistant. In general, different safety elements are provided on a package which aim to delay the time until an unauthorised person, for instance a child, is able to open the package. This extra time should allow an authorized person to interfere with the unauthorized person before opening of the package is completed. Thus, the term "child-resistant package" like it is used in the present application is to be understood as referring to a package which exhibits certain features for delaying access to the interior of the package.

SUMMARY OF THE INVENTION

In one aspect of the invention a child-resistant smoking article package is provided which comprises a case with an opening that is adapted to receive a smoking article and a cap movable between a closed state wherein the cap closes the case and an open state wherein the opening of the case is accessible. The child-resistant smoking article package further comprises a first releaseably engageable fixation member and a second and third releaseably engageable fixation member, wherein the second and third releaseably engageable fixation members are arranged on opposing sides of the child-resistant smoking article package. The first, second and third releaseably engageable fixation members are adapted to immovably fix the cap to the case in the closed state and to release the cap when they are simultaneously actuated.

An advantage of the child-resistant smoking article package according to the invention is that three releaseably engageable fixation members are arranged such that an opening of the package by a young child that tries to get access to the content of the package is prevented or at least is substantially complicated. Therefore, the child-resistant smoking article package according to the invention provides a storage possibility for smoking articles which is much safer than the solutions presented within the state of the art, regarding an access to the package by young children.

The characteristics, features and advantages of this invention and the manner in which they are obtained as described above, will become more apparent and be more clearly understood in connection with the following description of exemplary embodiments, which are explained with reference to the accompanied drawings.

BRIEF DESCRIPTION OF THE DRAWINGS

The drawings show in

DETAILED DESCRIPTION OF THE DRAWINGS

Figure 1A:
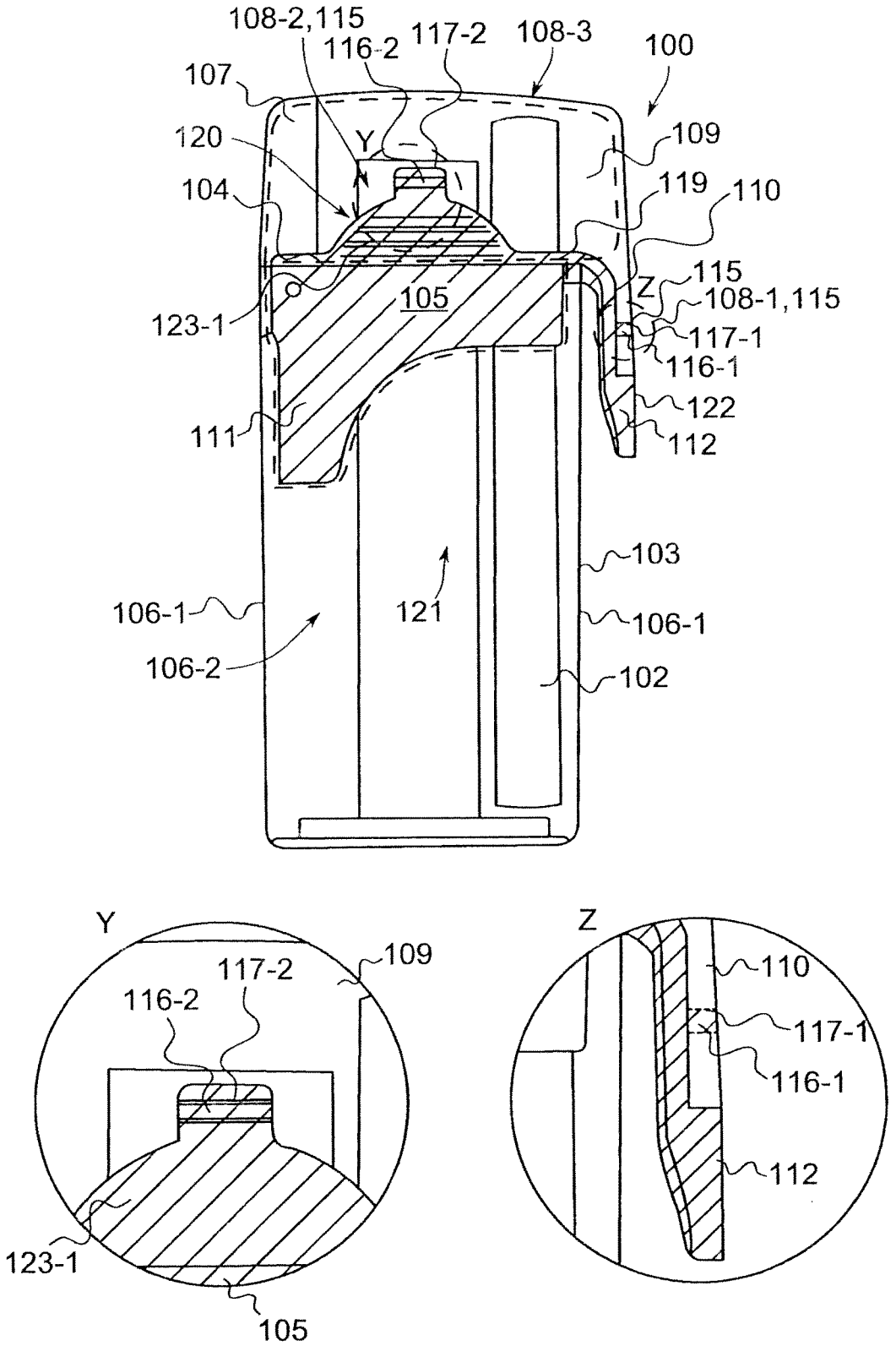
FIG. 1*a* to FIG. 1*c* three different views of a first embodiment of a closed child-resistant smoking article package according to the invention, FIG. 2*a* to FIG. 2*c* three side views of a cross-section of the first embodiment of a child-resistant smoking article package according to the invention in a closed state and in opened states, FIG. 3 an exploded view of the first embodiment of a child-resistant smoking article package according to the invention, FIG. 4*a* to FIG. 4*c* three different views of a second embodiment of a closed child-resistant smoking article package according to the invention, FIG. 5*a* to FIG. 5*c* three side views of a cross-section of the second embodiment of a child-resistant smoking article package according to the invention in a closed state and in opened states, and FIG. 6 an exploded view of the second embodiment of a child-resistant smoking article package according to the invention.
Figure 1B:
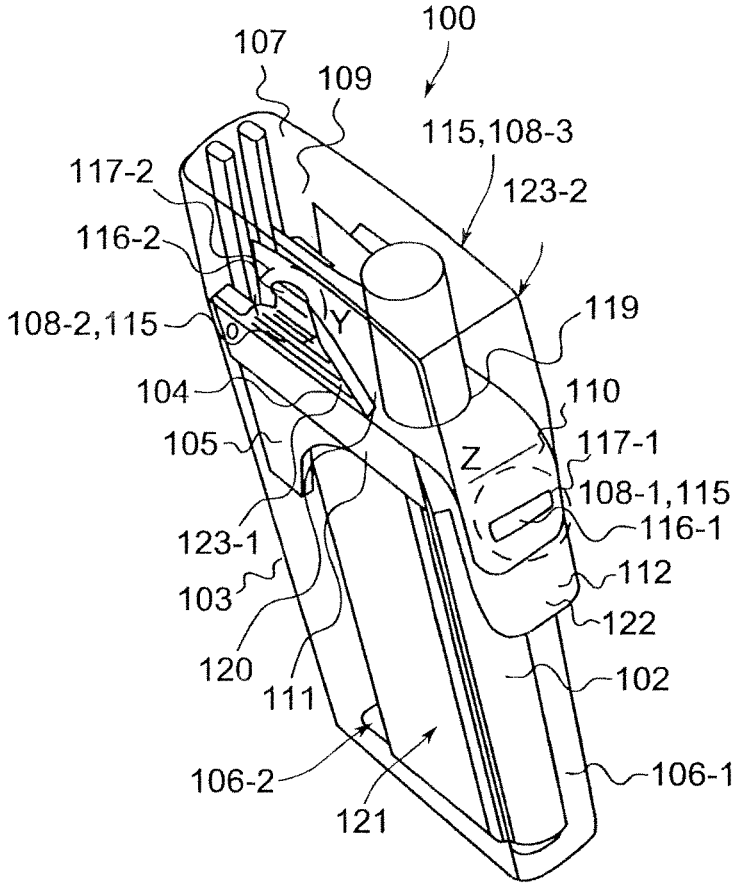
Figure 1B:
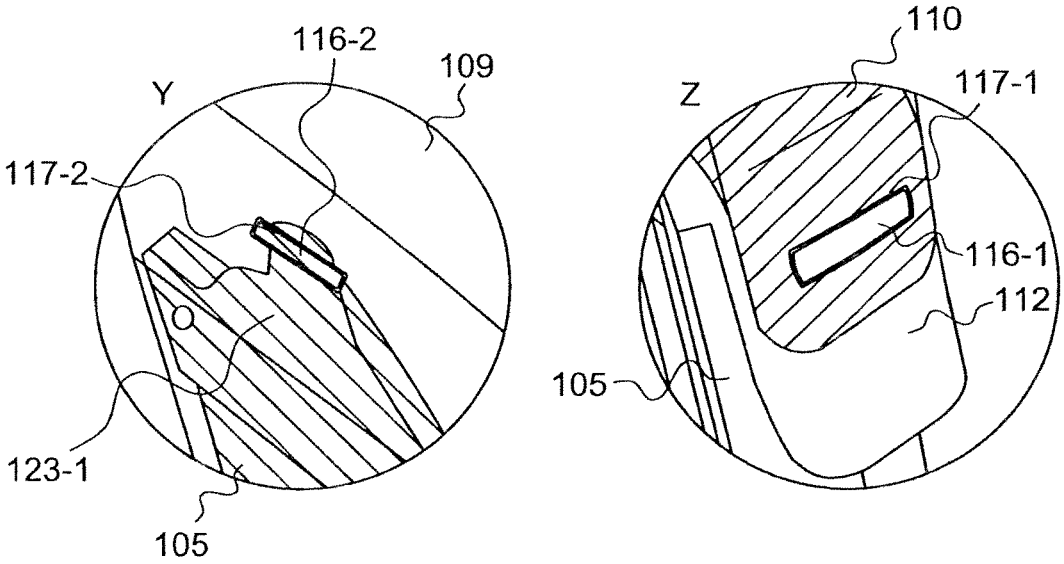
Figure 1C:
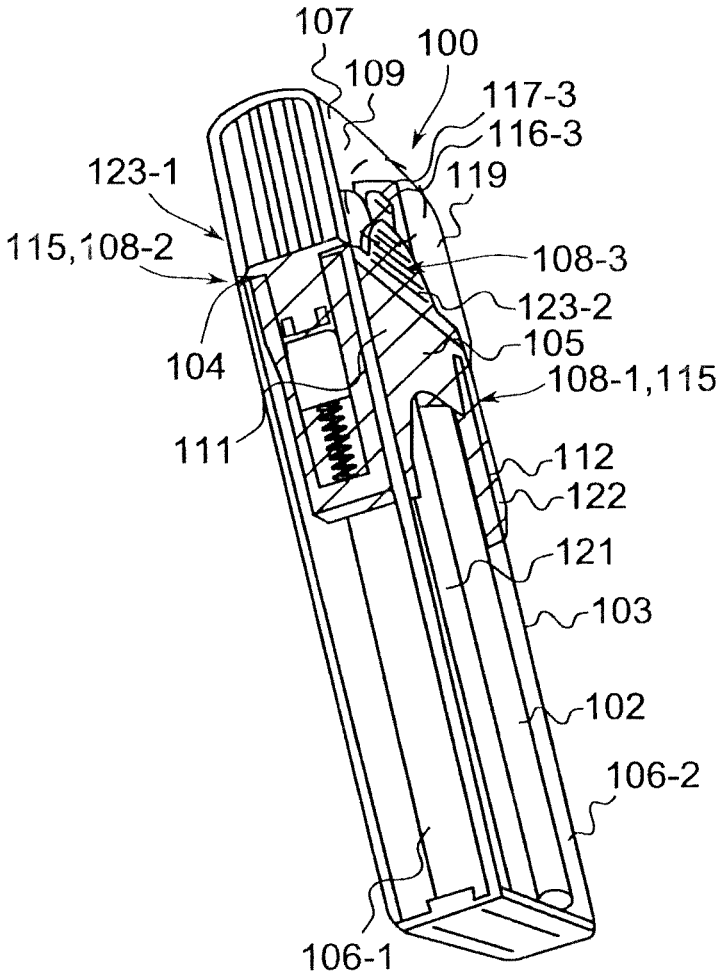

FIG. 1*a* to FIG. 1*c* show three different views of a first embodiment of a closed child-resistant smoking article package 100 according to the invention. In FIG. 1*a*, the first embodiment of a closed child-resistant smoking article package 100 is shown from a side, while it is shown in tilted views from the top and front in FIG. 1*b* and from the bottom and back in FIG. 1*c*. The child-resistant smoking article package 100 comprises a case 103 with an opening 104 which is adapted to receive a smoking article 102. In this first embodiment, the case 103 is exemplarily realized as a container with a substantially rectangular or cuboid shape that has two opposing narrow sides 106-1 and two opposing long sides 106-2. However, the invention is not limited to such cases 103 and other embodiments of child-resistant smoking article packages 100 according to the invention can have cases 103 with a shape and a form that fundamentally differs from the shape and the form of the case 103 as presented in the drawings of the application.

The child-resistant smoking article package 100 further comprises a cap 107 which is suited to close the case 103, wherein the cap 107 is movable between a closed state and an opened state of the child-resistant smoking article package 100. Furthermore, the child-resistant smoking article package 100 comprises a first releaseably engageable fixation member 108-1 and a second and third releaseably engageable fixation member 108-2, 108-3. The second and the third releaseably engageable fixation members 108-2, 108-3 are arranged on opposing sides of the child-resistant smoking article package 100, wherein the first, second and third releaseably engageable fixation members 108-1, 108-2, 108-3 are adapted to immovably fix the cap 107 to the case 103 in the closed state and to release the cap 107 when they are actuated. Expressed in other words, the first, second and third releaseably engageable fixation members 108-1, 108-2, 108-3 are adapted to substantially immovably fix the cap 107 to the case 103 in the closed state and to release the cap 107 when they are actuated.

In this first embodiment of the invention, the case 103 further comprises an optional insert 105 which is fixed within the case 103. The insert 105 fundamentally eases the production of the child-resistant smoking article package 100 and further enables an easy and handy handling of the same. The insert 105 exemplarily and optionally provides a location hole 119 for the smoking article 102, which in this first embodiment exemplarily is a rod-shaped electronic smoking device which is insertable into the location hole 119. Furthermore, the insert 105 exemplarily and optionally provides a holding 120 for a leaflet 121 that can be inserted into the holding 120 as it is shown in FIG. 1*a* to 1*c*. However, it is possible to realize child-resistant smoking article packages 100 according to the invention without any inserts 105 or with inserts 105 that fundamentally differ from the one shown in FIG. 1*a* to 1*c*. In this first embodiment of the child-resistant smoking article package 100, the cap 107 exemplarily comprises a base section 109 and an arm section 110, wherein the arm section 110 extends from the base section 109 along a direction that is parallel to the height of the case 103 in the closed state of the child-resistant smoking article package 100. Expressed in other words, the arm section 110 protrudes from the base section 109 along a part of a narrow side 106-1 of the case 103. Such a cap 107 enables the realization of an advantageous positioning of the first, second and third releaseably engageable fixation members 108-1, 108-2, 108-3 and gives the child-resistant smoking article package 100 a slim and practical design that is unique.

The insert 105 exemplarily comprises a body section 111 and a spring arm section 112, wherein the body section 111 is enclosed by the opening 104 and wherein the spring arm section 112 extends from the body section 111 along the arm section 110 of the cap 107. Expressed in other words, in this first embodiment of the invention, the spring arm section 112 of the insert 105 protrudes from the body section 111 and extends along a part of the narrow side 106-1 of the case 103. Furthermore, the spring arm section 112 is exemplarily biased against the arm section 110 of the cap 107 in the closed state of the child-resistant smoking article package 100. In such an embodiment of the invention, the spring arm section 112 of the insert 105 can advantageously interact with the arm section 110 of the cap 107 in order to enable an easy but safe realization of the first releaseably engageable fixation member 108-1.

In this first embodiment of the child-resistant smoking article package 100 according to the invention, the first releaseably engageable fixation member 108-1 is arranged on the spring arm section 112 of the insert 105 and is adapted to detachably fix the spring arm section 112 of the insert 105 and the arm section 110 of the cap 107 to one another. However, the invention is not limited thereto and it is possible to realize other embodiments of child-resistant smoking article packages 100 according to the invention with another positioning or arrangement of the first releaseably engageable fixation member 108-1, which for example also can be arranged on the arm section 110 of the cap 107. With the described arrangement of the first releaseably engageable fixation member 108-1, it is amongst others advantageously possible to detach the same with the thumb while holding the case 103 or the child-resistant smoking article package 100 as a whole in the palm of the left or the right hand.

In this first embodiment of the invention, the first releaseably engageable fixation member 108-1 is exemplarily realized as a snap-action connection 115 which comprises a first retaining lug 116-1 and a corresponding first fixation hole 117-1. Expressed in other words, the first releaseably engageable fixation member 108-1 is exemplarily realized as a snap-action connection 115 which comprises a first retaining lug 116-1 and a corresponding first fixation hole 117-1. Such snap-action connections 115 enable a stable, secure but safely releaseably engageable interconnection of the cap 107 and the case 103. In FIG. 1*a* to 1*c*, the child-resistant smoking article package 100 is shown in a closed state. In this closed state, the first retaining lug 116-1 of the snap-action connection 115 of the first releaseably engageable fixation member 108-1 is snapped into the corresponding first fixation hole 117-1. Expressed in other words, the first retaining lug 116-1 of the snap-action connection 115 of the first releaseably engageable fixation member 108-1 is engaged with the corresponding first fixation hole 117-1.

In this first embodiment of the invention, the first retaining lug 116-1 of the first releaseably engageable fixation member 108-1 is exemplarily arranged on the spring arm section 112 of the insert 105, wherein the corresponding first fixation hole 117-1 is arranged on the arm section 110 of the cap 107. However, it is also possible to realize embodiments of the present invention with a first retaining lug 116-1 which is arranged on the arm section 110 of the cap 107, wherein the corresponding first fixation hole 117-1 is arranged on the spring arm section 112 of the insert 105. An advantage of such a realization of the first releaseably engageable fixation member 108-1 is that in order to detach the first retaining lug 116-1 from the corresponding first fixation hole 117-1, the spring arm section 112 of the insert 105 just needs to be pushed or pulled into a direction towards the narrow side 106-1 of the case 103. Especially in FIGS. 1*a* and 1*b* it can be seen that the first retaining lug 116-1 and the corresponding first fixation hole 117-1 extend along a direction which is perpendicular to the long sides 106-2 of the case 103 and parallel to the narrow sides 106-1 of the case 103.

In this first embodiment of the invention, the spring arm section 112 comprises a freestanding actuation area 122 which is arranged adjacent to the snap-action connection 115 and accessible to a user of the child-resistant smoking article package 100. This freestanding actuation area 122 allows a user to push or pull the spring arm section 112 into a direction towards the narrow side 106-1 of the case 103 in order to detach the first retaining lug 116-1 from the corresponding first fixation hole 117-1, so to detach the snap-action connection 115 of the first releaseably engageable fixation member 108-1. However, it is also possible to realize child-resistant smoking article packages 100 without a freestanding actuation area 122 or with a freestanding actuation area 122 that is arranged on another position of the package 100, for example on the arm section 110 of the cap 107, adapted to be pushed or pulled in order to push or pull the arm section 110 of the cap 107 for detachment of the snap-action connection 115.

In the first embodiment shown in FIG. 1*a* to 1*c*, the body section 111 of the insert 105 exemplarily comprises the second and the third releaseably engageable fixation members 108-2, 108-3, adapted to fix the body section 111 of the insert 105 and the base section 109 of the cap 107 to one another. The second and third releaseably engageable fixation member 108-2, 108-3 are arranged on opposing sides of the insert 105 which extend along an area that is parallel or substantially parallel to the long sides 106-2 of the case 103 and will be described further hereinafter. With such a realization of the second and third releaseably engageable fixation members 108-2, 108-3, the child-resistant smoking article package 100 is especially secured against an undesired opening of the same by a young child, since both the second and the third releaseably engageable fixation members 108-2, 108-3 need to be actuated with for example one hand using at least two fingers, while at the same time the first releaseably engageable fixation member 108-1 needs to be actuated with for example the other hand using at least one finger. In such an embodiment, all three releaseably engageable fixation members 108-1, 108-2, 108-3 have to be actuated at the same time using for example both hands and at least three fingers, wherein the second and third releaseably engageable fixation members 108-2, 108-3 have to be actuated simultaneously, for example using a pinch-movement performed with at least two fingers of one or both hands.

In this first embodiment of the invention, also the second and the third releaseably engageable fixation members 108-2, 108-3 are realized as snap-action connections 115, each comprising a retaining lug 116-2, 116-3 and a corresponding fixation hole 117-2, 117-3. In more detail, in this first embodiment of the invention, the body section 111 of the insert 105 exemplarily comprises a first and a second insert protrusion 123-1, 123-2 which each exemplarily form a semi-circular prolongation of a respective long side 106-1, 106-2 of the case 103, wherein the retaining lugs 116-2, 116-3 of the snap-action connections 115 of the second and third releaseably engageable fixation members 108-2, 108-3 are respectively attached to the insert protrusions 123-1, 123-2 and protrude from the insert protrusions 123-1, 123-2 into the base section 109 of the cap 107. In this first embodiment, the base section 109 of the cap has semi-circular cavities which correspond to the insert protrusions 123-1, 123-2 and provides fixation holes 117-2, 117-3 that correspond to the retaining lugs 116-2, 116-3 of the snap-action connections 115 of the second and third releaseably engageable fixation members 108-2, 108-3. In this first embodiment of the invention, the retaining lugs 116-2, 116-3 of the second and third releaseably engageable fixation members 108-2, 108-3 snap into the corresponding fixation holes 117-2, 117-3 from an inside of the cap 107 as soon as the child-resistant smoking article package 100 is closed with the cap 107 or in other words transferred to a closed state. The semi-circular parts of the insert protrusions 123-1, 123-2 exemplarily and optionally have a corrugated surface and represent freestanding actuation areas which allow a user to push the retaining lugs 116-2, 116-3 of the second and third releaseably engageable fixation members 108-2, 108-3 out of their respective corresponding fixation holes 117-2, 117-3 in order to detach the snap-action connections 115 of the second and third releaseably engageable fixation members 108-2, 108-3. Expressed in other words, the semi-circular parts of the insert protrusions 123-1, 123-2 represent freestanding actuation areas which are suited to be pushed in order to push the retaining lugs 116-2, 116-3 of the second and third releaseably engageable fixation members 108-2, 108-3 into a direction towards the inside of the cap 107, for example with a pinch-movement.

In this first embodiment of the invention, the first releaseably engageable fixation member 108-1 and the second and third releaseably engageable fixation members 108-2, 108-3 are arranged on sides of the child-resistant smoking article package 100 which are perpendicular to one another. Expressed in other words, in this first embodiment of the invention, the first releaseably engageable fixation member 108-1 and the second and third releaseably engageable fixation members 108-2, 108-3 are arranged on sides of the child-resistant smoking article package 100 which are substantially perpendicular to one another. In other words, the first releaseably engageable fixation member 108-1 is arranged in a plane that is perpendicular or substantially perpendicular to the planes the second and third releaseably engageable fixation members 108-2, 108-3 are arranged in, respectively. In such an embodiment it is assured that two hands are needed to actuate the three releaseably engageable fixation members 108-1, 108-2, 108-3 simultaneously in order to open the child-resistant smoking article package 100. It is further possible to realize child-resistant smoking article packages 100 according to the invention with snap-action connections 115 as described above that have corresponding fixation edges instead of fixation holes 117.

In FIGS. 1*a* and 1*b*, a detailed view denoted by Z of the first releaseably engageable fixation member 108-1 and a detailed view denoted by Y of the second releaseably engageable fixation member 108-2 of the first embodiment is shown. In more detail, the detailed view denoted Z shows the first retaining lug 116-1 of the first releaseably engageable fixation member 108-1 which forms a part of the spring arm section 112 of the insert 105. The first retaining lug 116-1 is engaged with the first fixation hole 117-1 of the first releaseably engageable fixation member 108-1. The first fixation hole 117-1 is arranged within an arm section 110 of the cap 107 and corresponds to the first retaining lug 116-1. The detailed view denoted Y shows the second retaining lug 116-2 of the second releaseably engageable fixation member 108-2 which forms a part of an insert protrusion 123-1 of the insert 105. The second retaining lug 116-2 is engaged with the second fixation hole 117-2 of the second releaseably engageable fixation member 108-2. The second fixation hole 117-2 is arranged within the base section 109 of the cap 107. For an engagement of the second releaseably engageable fixation member 108-2, the insert protrusion 123-1 of the insert 105 is inserted into the cap 107 until the second retaining lug 116-2 engages with the second fixation hole 117-2.

Figure 2A:
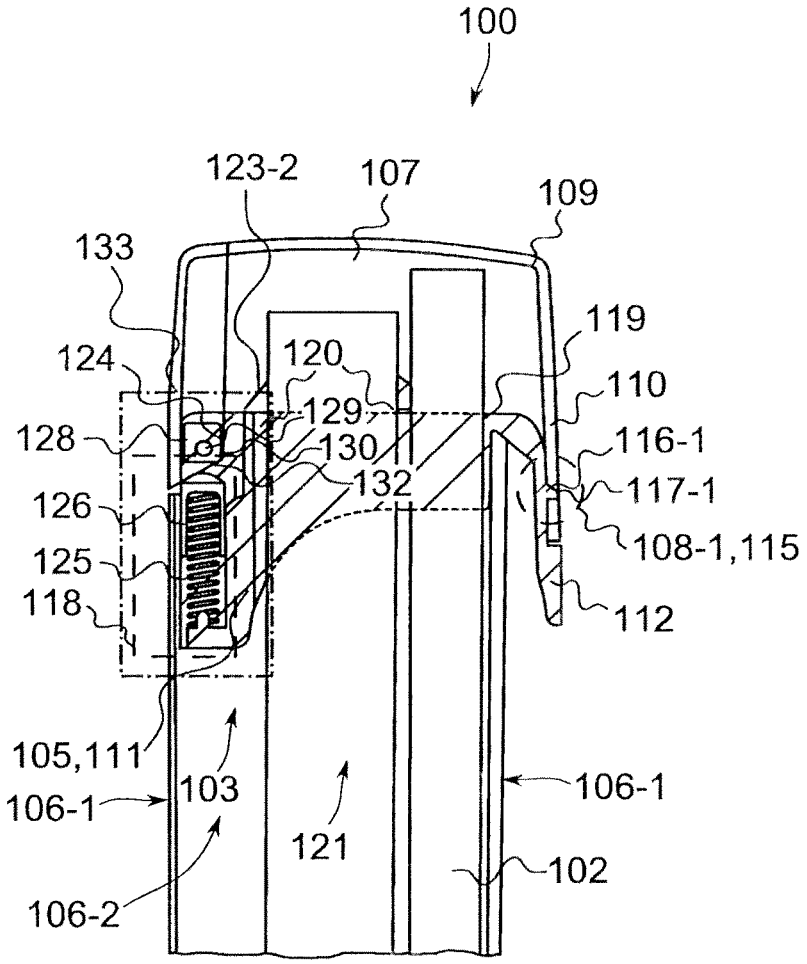
Figure 2B:
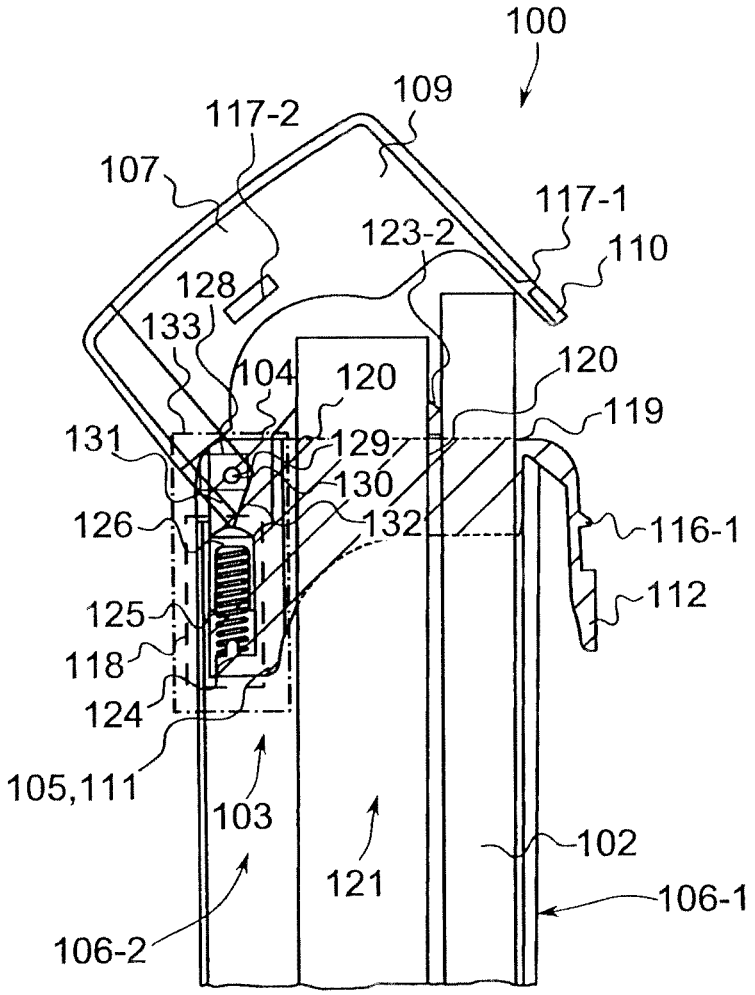
Figure 2C:
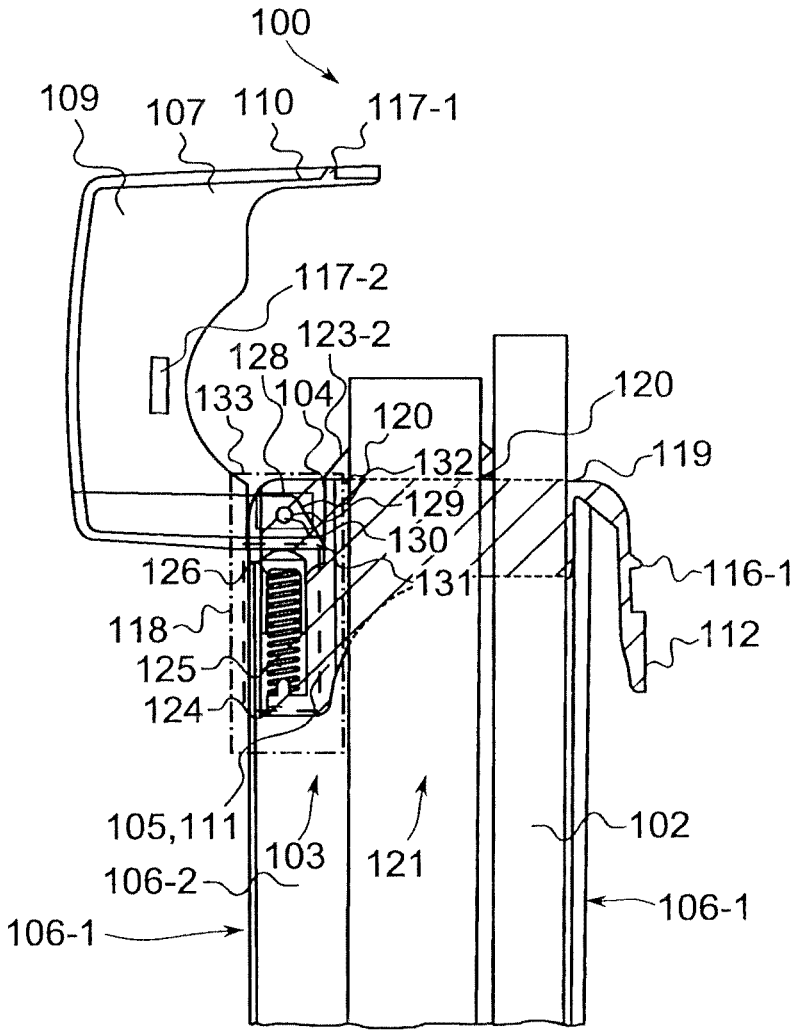

FIG. 2*a* to FIG. 2*c* show three side views of a cross-section of the first embodiment of a child-resistant smoking article package 100 according to the invention in a closed state and in opened states. The components of FIG. 2*a* to FIG. 2*c* with reference signs which are identical to the respective reference signs shown in FIG. 1*a* to FIG. 1*c* will not be described further hereinafter. However, the description related to these components is also applicable to the components with identical reference signs shown in FIG. 2*a* to FIG. 2*c*. In FIG. 2*a* to FIG. 2*c*, a cross section parallel to a long side 106-2 of the case 103 of the first embodiment of a child-resistant smoking article package 100 is shown. In FIG. 2*a*, the first embodiment of a child-resistant smoking article package 100 is shown in a closed state, while in FIGS. 2*b* and 2*c*, the first embodiment of a child-resistant smoking article package 100 is shown in an opened state.

In this first embodiment of the invention, the child-resistant smoking article package 100 exemplarily comprises a spring system 118 as a part of a snap-action mechanism 133, wherein the spring system 118 is adapted to exert a force on the cap 107 in order to maintain the child-resistant smoking article package 100 in a closed state as is shown in FIG. 2*a*. With such a spring system 118, the child-resistance of the package 100 is further increased, since a young child that tries to open the package 100 not only has to actuate all the three releaseably engageable fixation members 108-1, 108-2, 108-3 simultaneously, but also has to lift the cap 107 from the case 103, since the spring system 118 pushes it into the closed state of the child-resistant smoking article package 100. If, for example, all three releaseably engageable fixation members 108-1, 108-

2, 108-3 are actuated while the child-resistant smoking article package 100 is held with the cap 107 pointing towards the floor or ground, the child-resistant smoking article package 100 still does not open since the spring system 118 will keep the package 100 in a closed state.

In this first embodiment of the invention, the insert 105 exemplarily defines an elongate cavity 124 which is adapted to receive the spring system 118. In this embodiment, the spring system 118 comprises a spring 125 and a pin 126 which is mounted on the spring 125. In this first embodiment of the child-resistant smoking article package 100, the package 100 further comprises a hinge 128 comprising a rod 129 which protrudes through corresponding mounting holes 130 which are provided within the case 103 and within the insert 105 and which movably attaches the cap 107 to the case 103. The spring system 118 is arranged adjacent to the hinge 128, wherein the pin 126 of the spring system 118 rests against a surface 132 of a portion 131 of the base section 109 of the cap 107 which in this first embodiment is tapered in relation to an area which is enclosed by the rim of the opening 104 of the case 103 with the pin 126 being slidable long this tapered surface 132. This tapered surface 132 encloses an open end of the elongate cavity 124.

In FIG. 2*a*, the child-resistant smoking article package 100 is in a closed state and the cap 107 is in a first stable state. The lateral extent of the elongate cavity 124 is such that in this closed state, the surface of the pin 126 is in contact with the tapered surface 132 of the portion 131 of the cap 107 with the spring 125 slightly compressed. Thus, the spring system 118 exerts a force on the cap 107 via the tapered surface 132 keeping it in a closed state.

In this closed state, the retaining lugs 116-1, 116-2, 116-3 of the first, second and third releaseably engageable fixation members 108-1, 108-2, 108-3 are snapped in the corresponding fixation holes 117-1, 117-2, 117-3. In FIG. 2*b*, the child-resistant smoking article package 100 is shown in an opened and instable state. In order to transfer the cap 107 to this opened state, the user of the child-resistant smoking article package 100 has to actuate all three releaseably engageable fixation members 108-1, 108-2, 108-3 simultaneously and then rotate the cap 107 about the hinge 128. The rotation of the cap 107 pushes the tapered surface 132 against the pin 125 compressing the spring 125. This continues until the cap 107 reaches the position shown in FIG. 2*b* where the tip of the tapered surface 132 is in contact with the surface of the pin 126.

If the cap 107 is further rotated about the hinge 128 it will then move into a stable opened state which is shown in FIG. 2*c*. In this stable opened state, the surface of the pin 126 is in contact with an edge of the portion 131 of the cap 107 which is adjacent to the tapered surface 132. Also in this stable opened state, the spring system 118 exerts a force on the cap 107 via the portion 131 of the cap 107, keeping it in the stable opened state.

Conversely, if no further rotation is applied to the cap 107, the exertion of force by the pin 126 against the tapered surface 132 by the spring 125 will cause the cap 107 to snap shut and return to the closed configuration of FIG. 2*a*.

Figure 3:
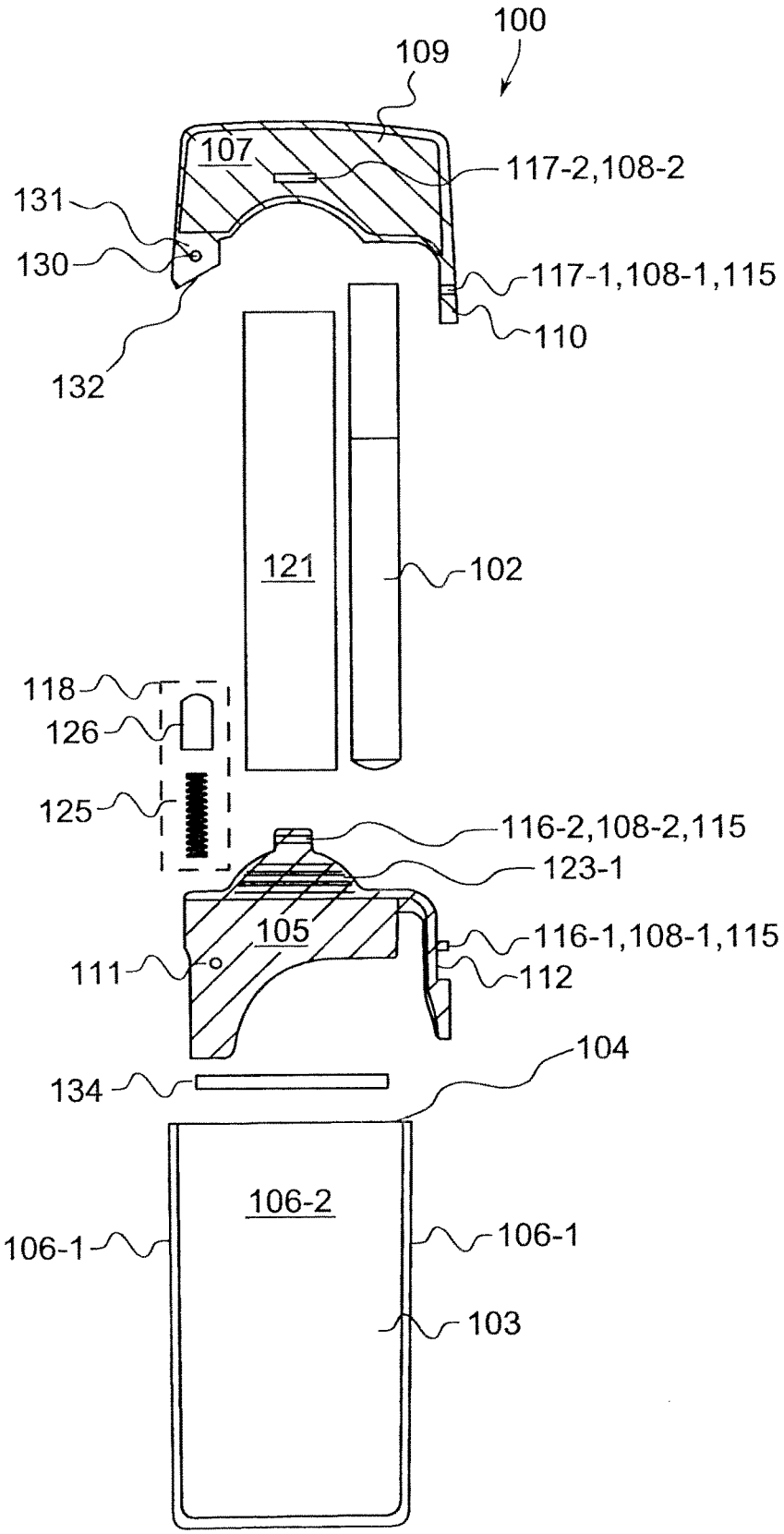

FIG. 3 shows an exploded view of the first embodiment of a child-resistant smoking article package 100 according to the invention. The components of FIG. 3 with reference signs which are identical to the respective reference signs shown in FIG. 1*a* to FIG. 1*c* and FIGS. 2*a* to 2*c* will not be described explicitly hereinafter. However, the description related to these components is also applicable to the components with identical reference signs shown in FIG. 3. In FIG. 3, the components of the first embodiment of a child-resistant smoking article package 100 according to the invention are shown in an order in which they are assembled in order to form the child-resistant smoking article package 100. Below in FIG. 3, it is shown the substantially rectangular or cuboid shaped case 103 of the child-resistant smoking article package 100, followed by an optional foam sticker 134. The case 103 has two opposing narrow sides 106-1 and two opposing long sides 106-2 which enclose an opening 104. When the child-resistant smoking article package 100 is assembled, the foam sticker 134 is arranged within the case 103 and in between the bottom of the case 103 and the insert 105. The insert 105 optionally comprises a location hole (not shown) for the smoking article 102 and a holding (not shown) for the leaflet 121. The insert 105 further comprises a body section 111 and a spring arm section 112, extending from the body section 111 along the narrow side 106-1 of the case 103 when the child-resistant smoking article package 100 is assembled and the insert 105 is inserted into the opening 104 of the case 103. The body section 111 of the insert 105 exemplarily comprises a first and a second insert protrusion 123-1, 123-2, wherein only the first insert protrusion 123-1 is visible in FIG. 3. The first and second insert protrusions 123-1, 123-2 form a solid part of the body section 111 of the insert 105 and exemplarily form a semi-circular prolongation of a respective long side 106-2 of the case 103, when the child-resistant smoking article package 100 is assembled.

A first retaining lug 116-1 of a first releaseably engageable fixation member 108-1 is arranged on the spring arm section 112 of the insert 105. A second retaining lug 116-2 of a second releaseably engageable fixation member 108-2 is arranged on the first insert protrusion 123-1 and a third retaining lug 116-3 of a third releaseably engageable fixation member 108-3 is arranged on the second insert protrusion 123-2 (not shown in FIG. 3). In this first embodiment of the child-resistant smoking article package 100 according to the invention, the first, second and third releaseably engageable fixation members 108-1, 108-2, 108-3 are each realized as snap-action connections 115. The second and third retaining lugs 116-2, 116-3 are arranged on opposing sides of the insert 105. Moreover, the spring system 118 is shown in FIG. 3, comprising a spring 125 and a pin 126 which is arranged on the spring 125 in an assembled state of the child-resistant smoking article package 100, in which the spring system 118 is arranged within the insert 105.

The case 103 can be closed with a cap 107 which in the first embodiment of the child-resistant smoking article package 100 exemplarily comprises a base section 109 and an arm section 110. The arm section 110 extends from the base section 109 along a direction that is parallel to the narrow sides 106-1 of the case 103 when the child-resistant smoking article package 100 is assembled and closed. The base section 109 comprises a portion 131 which extends along a direction which is parallel to the arm-section 110 of the cap 107 and which has a tapered surface 132. When the child-resistant smoking article package 100 is assembled, the tapered surface 132 of the portion 131 of the base section 109 is in contact with the surface of the pin 126. A first fixation hole 107-1 corresponding to the first retaining lug 106-1 is arranged within the arm section 110 of the cap 107. Furthermore, a second fixation hole 117-2 corresponding to the second retaining lug 116-2 is arranged within the base section 109 of the cap 107. Moreover, a third fixation hole 117-3 (not shown) corresponding to the third retaining lug 116-3 (not shown) is arranged within the base section 109 of the cap 107. The second fixation hole 117-2 and the third fixation hole 117-3 are arranged on opposing sides of the cap 107. In a closed state of the assembled child-resistant smoking article package 100, the first retaining lug 116-1 is releaseably engaged with the first fixation hole 117-1, the second retaining lug 116-2 is releaseably engaged with the second fixation hole 117-2 and the third retaining lug 116-3 is releaseably engaged with the third fixation hole 117-3.

Figure 4A:
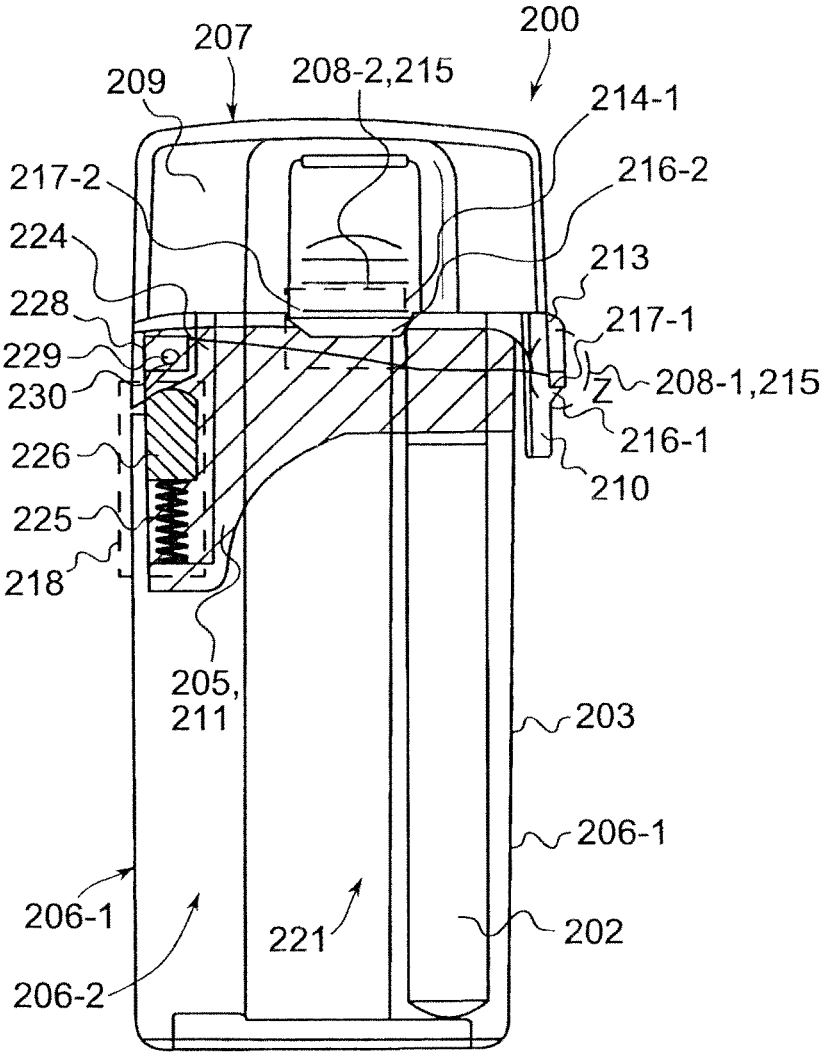
Figure 4A:
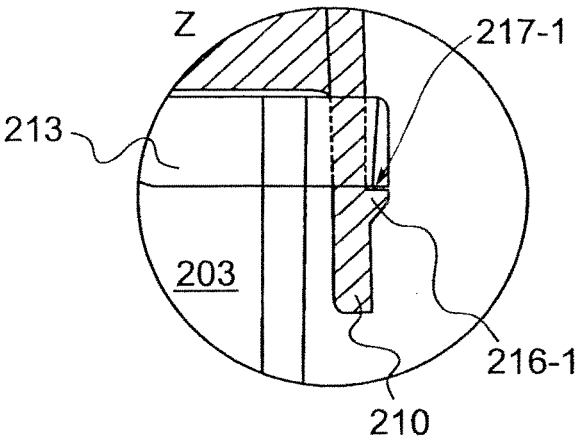
Figure 4B:
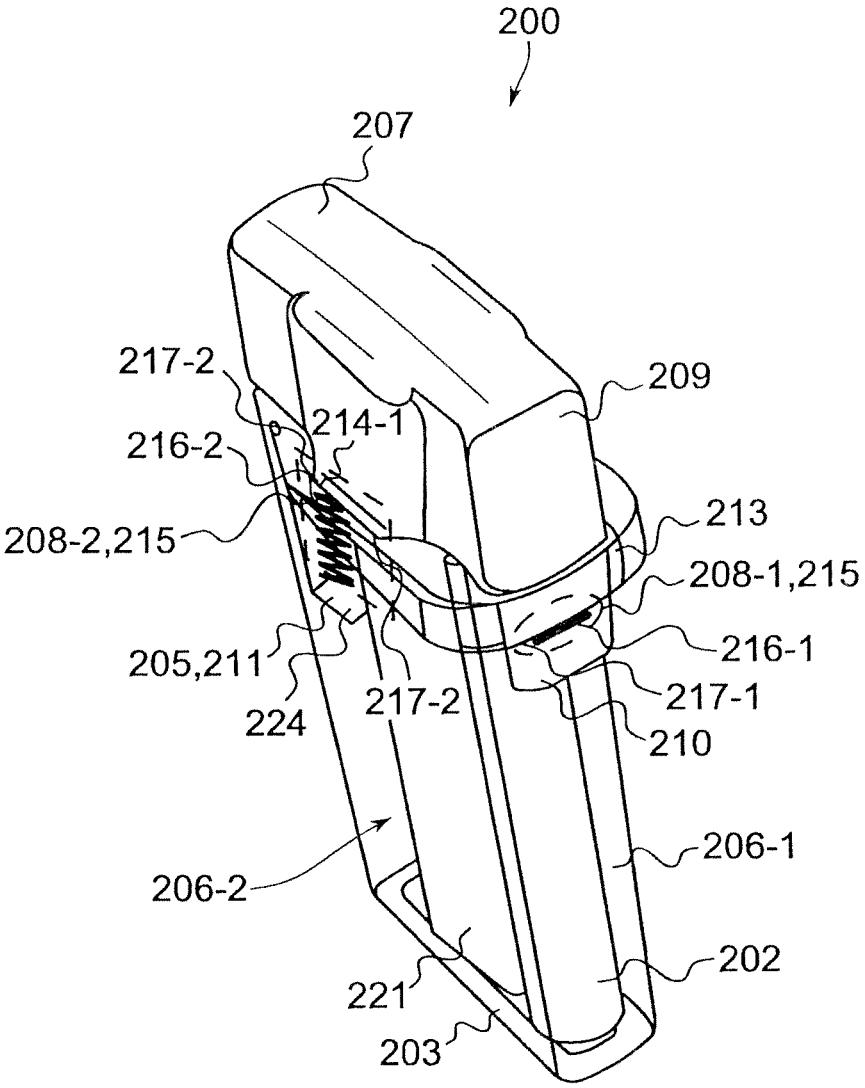
Figure 4C:
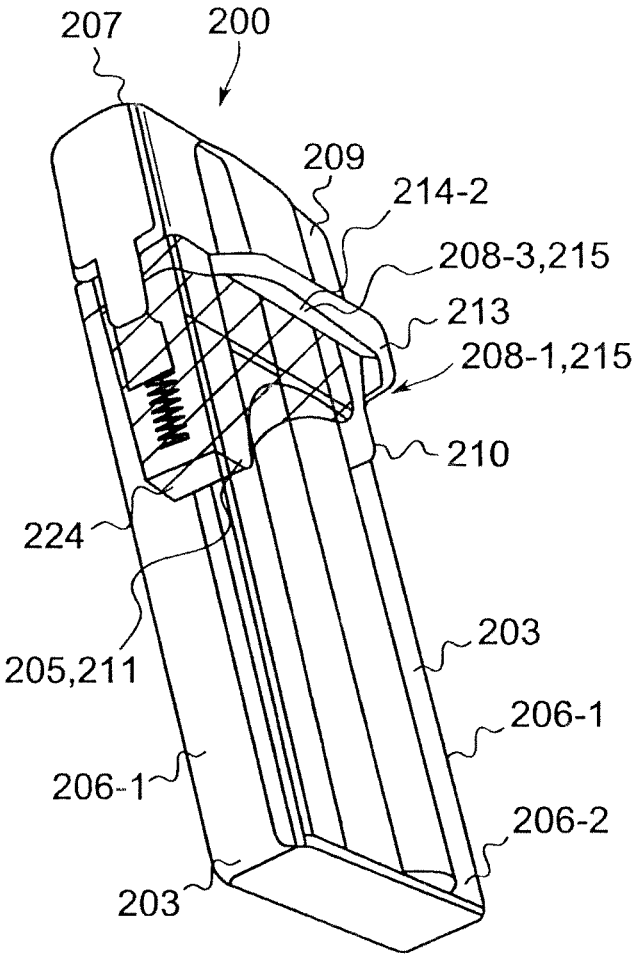

In FIG. 4*a* to FIG. 4*c* are three different views of a second embodiment of a child-resistant smoking article package 200 according to the invention in a closed configuration. The second embodiment shown in FIG. 4*a* to FIG. 4*c* is substantially identical to the first embodiment of the child-resistant smoking article package 100 as shown in FIG. 1*a* to FIG. 1*c*, FIG. 2*a* to FIG. 2*c* and FIG. 3 and as described hereinbefore. However, some of the components differ as will now be described hereinafter.

In FIG. 4*a*, the second embodiment of a closed child-resistant smoking article package 200 is shown from a side, while it is shown in tilted views from the top and front in FIG. 4*b* and from the bottom and back in FIG. 4*c*. In this second embodiment of the invention the insert 205 only comprises a body section 211 which is fixed within the case 203. The insert 205 does not comprise a first or a second insert protrusion 123-1, 123-2 nor does it comprise a spring arm section 112. The cap 207 comprises a base section 209 and an arm section 210 which extends from the base section 209 along a direction that is parallel to the height of the case 203 in the closed state of the child-resistant smoking article package 200 as described hereinbefore for the cap 207 of the first embodiment of the invention. In the second embodiment, the child-resistant smoking article package 200 further exemplarily comprises a retaining bracket 213 which is fixed to the case 203 and which embraces the arm section 210 of the cap 207 when the child-resistant smoking article package 200 is in a closed configuration. Moreover, the arm section 210 of the cap 207 comprises a first releaseably engageable fixation member 208-1, which is adapted to detachably fix the retaining bracket 213 and the arm section 210 to one another.

However, it is also possible to realize child-resistant smoking article packages 200 according to the invention with a first releaseably engageable fixation member 208-1 which is arranged on the retaining bracket 213. In such embodiments, an alternative fixation technique using an additional component is used to realize the first releaseably engageable fixation member 208-1. The retaining bracket 213 provides further advantages besides stable releaseably engageable fixation of the cap 207 to the case 203 via the first releaseably engageable fixation member 208-1. For example, it offers the possibility to easily attach the child-resistant smoking article package 200 to other objects and additionally protects the child-resistant smoking article package 200 and its content against an external exertion of force, for example when the package 200 falls to the ground or floor and drops on a narrow or long side 206-1, 206-2 of the case 203.

The retaining bracket 213 is attached to the opposing long sides 206-2 of the case 203 in an area that is adjacent to its opening 204. It extends along a direction which is parallel to an area enclosed by the rim of the opening 204 of the case 203. In the closed state of the child-resistant smoking article package 200, the retaining bracket 213 functions as a holder for the arm section 210 of the cap 207, which in the closed state of the package 200 is positioned in between a narrow side 206-1 of the case 203 and the retaining bracket 213. In this second embodiment of the invention, the first releaseably engageable fixation member 208-1 is also realized as a snap-action connection 215, comprising a first retaining lug 216-1 and a corresponding first fixation edge 217-1. The first retaining lug 216-1 is arranged on the arm section 209 and extends towards the retaining bracket 213. The retaining bracket 213 exemplarily provides a first fixation edge 217-1 on a bottom side of the bracket 213 which corresponds to the first retaining lug 216-1 of the arm section 210 of the cap 207. In such an embodiment, the first retaining lug 216-1 of the arm section 210 moves under the corresponding first fixation edge 217-1 and engages with the same as soon as the child-resistant smoking article package 200 is transferred from an opened state into a closed state. This construction provides a handy but child-resistant realization of the first releaseably engageable fixation member 208-1, allowing a user of the child-resistant smoking article package 200 to actuate the same for example with the thumb while holding the package 200 in the palm of the same hand.

The part of the arm section 210 of the cap 207 extending beneath the first retaining lug 216-1 of the first releaseably engageable fixation member 208-1 provides a freestanding actuation area that can be pressed or pushed into a direction pointing towards the narrow side 206-1 of the case 203 by a user in order to detach the first retaining lug 216-1 from the first fixation edge 217-1, so to detach the snap-action connection 215. Expressed in other words, the first releaseably engageable fixation member 208-1 can be actuated and detached by pushing the freestanding actuation area of the arm section 210 into a direction towards the narrow side 206-1 of the case 203. In order to transfer the child-resistant smoking article package 200 from the closed state into the opened state, the first releaseably engageable fixation member 208-1 has to be actuated as described above and the cap 207 further has to be lifted from the case 203. While the cap 207 is lifted from the case 203, the first retaining lug 216-1 arranged on the arm section 210 of the cap 207 slides along an inner side of the retaining bracket 213.

In this second embodiment of the present invention, the base section 209 of the cap 207 exemplarily comprises a first and a second protrusion 214-1, 214-2 with the second and the third releaseably engageable fixation members 208-2, 208-3 arranged thereon respectively, adapted to detachably fix the base section 209 of the cap 207 and the case 203 to one another. Expressed in other words, in this second embodiment of the child-resistant smoking article package 200, the base section 209 of the cap 207 exemplarily comprises a first and a second protrusion 214-1, 214-2 which are arranged on opposing sides of the cap 207. The first protrusion 214-1 comprises the second releaseably engageable fixation member 208-2 and the second protrusion 214-2 comprises the third releaseably engageable fixation member 208-3. However, it is also possible to realize child-resistant smoking article packages 200 with first and second protrusions 214-1, 214-2 that are comprised by the case 203. Furthermore, it is possible to realize child-resistant smoking article packages 200 with second and third releaseably engageable fixation members 208-2, 208-3 which are directly attached to the cap 207 and/or to the case 203, so without any protrusions 214-1, 214-2. An advantage of such an arrangement of the second and third releaseably engageable fixation members 208-2, 208-3 within the cap 207 is given in that the cap 207 directly can be lifted from the case 203 when the second and third releaseably engageable fixation members 208-2, 208-3 are actuated. In this second embodiment of the invention, the first and second protrusions 214-1, 214-2 protrude into the case 203, so inside the case 203.

Also in this second embodiment, the second and third releaseably engageable fixation members 208-2, 208-3 are exemplarily realized as snap-action connections 215, each comprising a retaining lug 216-2, 216-3 and a corresponding fixation hole 217-2, 217-3. Such snap-action connections 215 enable a stable and secure but safely releaseably engageable interconnection of the cap 207 and the case 203 and increase the child-resistance of the child-resistant smoking article package 200. The first and second protrusions 214-1, 214-2 extend from the base section 209 of the cap 207 towards and along the inner long sides 206-2 of the case 203 in a closed state of the child-resistant smoking article package 200. Expressed in other words, the first and second protrusions 214-1, 214-2 protrude into the interior of the case 203. In this second embodiment of the invention, the retaining lugs 216-2, 216-3 of the second and third releaseably engageable fixation members 208-2, 208-3 are arranged on the base section 209 of the cap 207. The respective corresponding fixation holes 217-2, 217-3 are arranged on the case 203. In more detail, the retaining lugs 216-2, 216-3 of the snap-action connections 215 of the second and third releaseably engageable fixation members 208-2, 208-3 are arranged on the first and second protrusions 214-1, 214-2 respectively and extend along a direction that is parallel to the long sides 206-2 of the case 203 and perpendicular to the narrow sides 206-1 of the case 203. The fixation holes 217-2, 217-3 that correspond to the retaining lugs 216-2, 216-3 of the snap-action connections 215 of the second and third releaseably engageable fixation members 208-2, 208-3 are arranged within the long sides 206-2 of the case 203 and positioned adjacent to the rim of the opening 204 of the case 203. When the child-resistant smoking article package 200 is transferred from an opened state into a closed state, the retaining lugs 216-2, 216-3 of the second and third releaseably engageable fixation members 208-2 and 208-3 slide along the inner long sides 206-2 of the case 203 until they snap in the corresponding fixation holes 217 and engage with the same.

In this second embodiment of the child-resistant smoking article package 200, the first and second protrusions 214-1, 214-2 are connected to elastic freestanding actuation areas that each exemplarily and optionally have a corrugated surface and form a spring arm respectively. For an actuation of the second and third releaseably engageable fixation members 208-2, 208-3, the respective actuation areas have to be pushed towards a direction that is pointing inside the cap 207. Expressed in other words, in order to detach the snap-action connections 215 of the second and third releaseably engageable fixation members 208-2, 208-3, a force has to be exerted on the freestanding actuation areas of the first and second protrusion 214-1, 214-2. The second and third releaseably engageable fixation members 208-2, 208-203 can be detached simultaneously for example with a pinch-movement that is performed with two fingers of the same hand, pushing the freestanding actuation areas of the first and second protrusions 214-1, 214-2 towards each other and the retaining lugs 216-2, 216-3 of the respective snap-action connections 215 out of their respective fixation holes 217-2, 217-3.

Also in this second embodiment of the invention, the first releaseably engageable fixation member 208-1 and the second and third releaseably engageable fixation members 208-2, 208-3 are arranged on sides of the child-resistant smoking article package 200 which are perpendicular to one another. Expressed in other words, in this second embodiment of the invention, the first releaseably engageable fixation member 208-1 and the second and third releaseably engageable fixation members 208-2, 208-3 are arranged on sides of the child-resistant smoking article package 200 which are substantially perpendicular to one another. The first releaseably engageable fixation member 208-1 is arranged in a plane that is perpendicular or substantially perpendicular to the planes the second and third releaseably engageable fixation members 208-2, 208-3 are arranged in respectively. In such an embodiment it is assured that two hands are needed to actuate the three releaseably engageable fixation members 208-1, 208-2, 208-3 simultaneously in order to open the child-resistant smoking article package 200.

Furthermore, in this second embodiment of the invention, the insert 205 exemplarily defines an elongate cavity 224 which is adapted to receive a spring system 218. In this embodiment, the spring system 218 comprises a spring 225 and a pin 226 which is mounted on the spring 225. In this second embodiment of the child-resistant smoking article package 200, the package 200 further comprises a hinge 228 comprising a rod 229 which protrudes through corresponding mounting holes 230 which are provided within the case 203 and within the insert 205. The hinge 228 movably attaches the cap 207 to the case 203. Furthermore, in this second embodiment of the invention, the insert 205 exemplarily and optionally provides a holding for a leaflet 221 that can be inserted into the holding and a location hole for a smoking article 202 that can be inserted into the location hole.

Figure 5A:
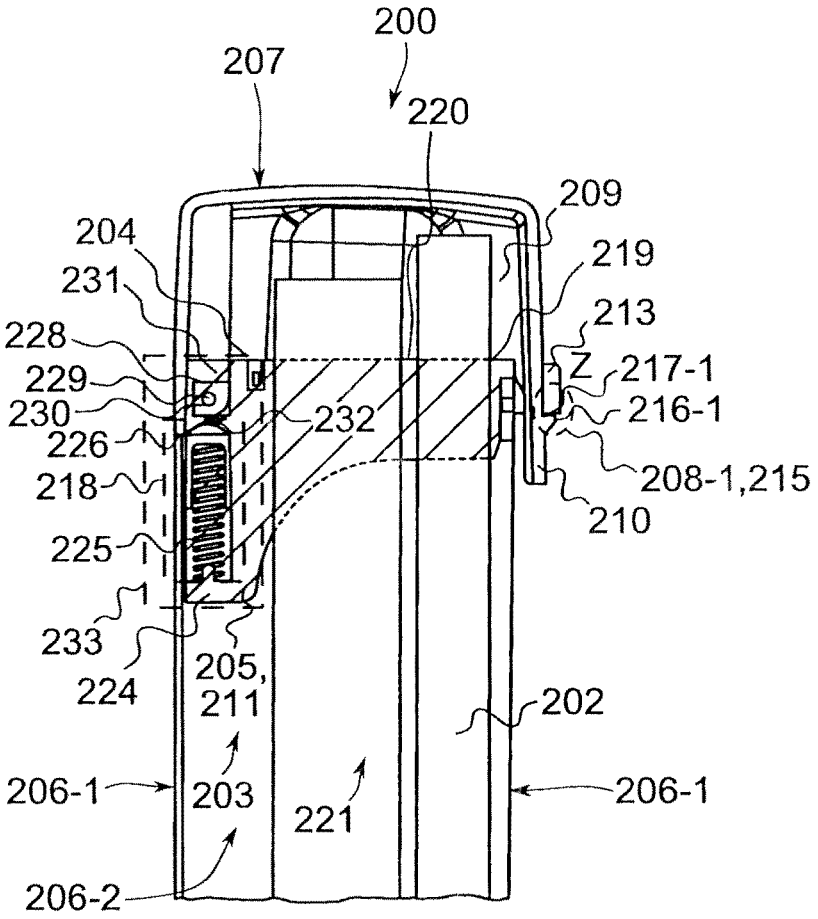
Figure 5A:
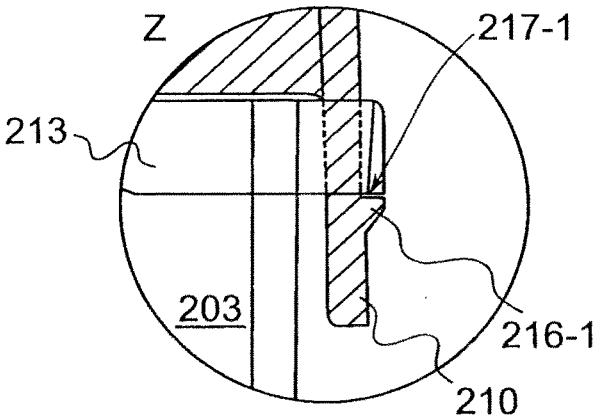
Figure 5B:
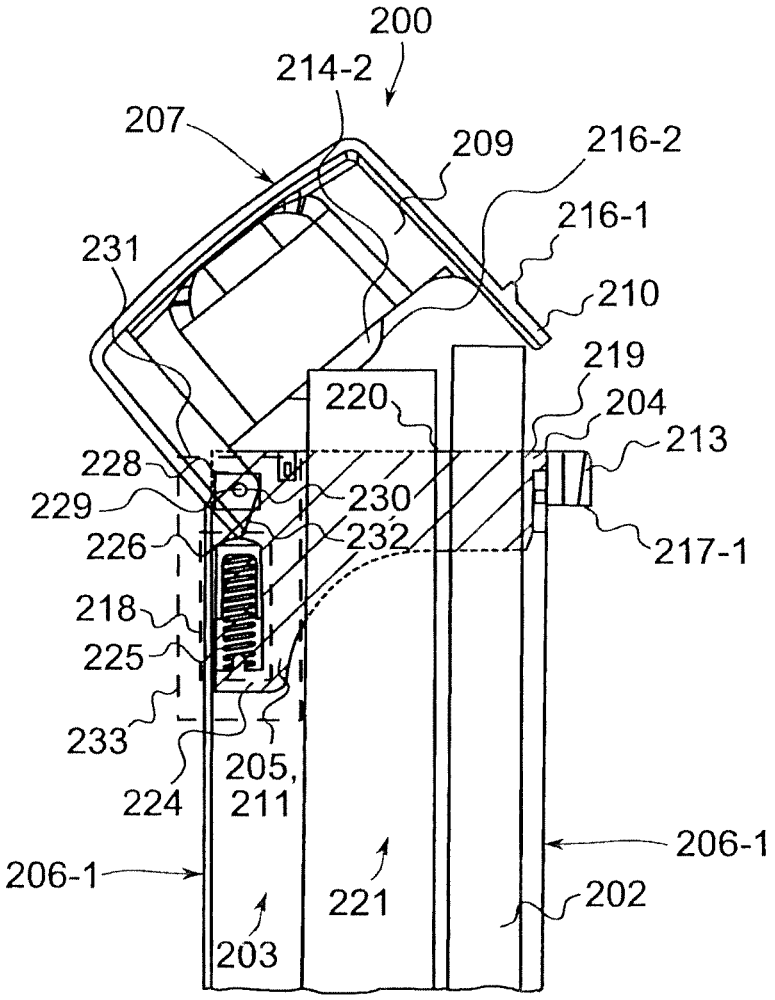
Figure 5C:
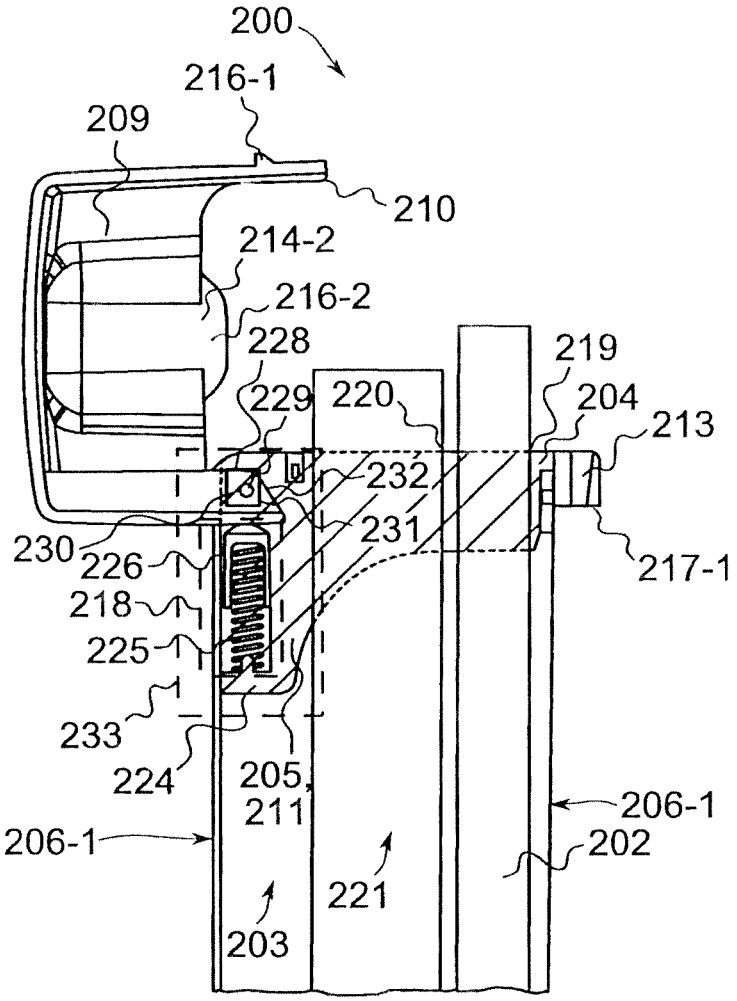

In FIG. 5*a* to FIG. 5*c*, three side views of the second embodiment of a child-resistant smoking article package 200 according to the invention are shown in a closed state and in opened states. The components of FIG. 5*a* to FIG. 5*c* with reference signs which are identical to the respective reference signs shown in FIG. 4*a* to FIG. 4*c* will not be described further hereinafter. However, the description related to these components is also applicable to the components with identical reference signs shown in FIG. 5*a* to FIG. 5*c*. In FIG. 5*a* to FIG. 5*c*, a cross section parallel to a long side 206-2 of the case 203 of the second embodiment of a child-resistant smoking article package 200 is shown. In FIG. 5*a*, the second embodiment of a child-resistant smoking article package 200 is shown in a closed state, while in FIGS. 5*b* and 5*c*, the second embodiment of a child-resistant smoking article package 200 is shown in an opened state. In this second embodiment, the child-resistant smoking article package 200 comprises the snap-action mechanism 233 of the first embodiment which was already described above and which is shown in FIGS. 2*a* to 2*c*. This snap-action mechanism 233 comprises a spring system 218 which is arranged in a cavity 224 that is provided by the insert 205. The spring system 218 comprises a spring 225 and a pin 226 which is arranged on the spring 225. The cap 207 of the child-resistant smoking article package 200 is movably attached to the case 203 via a hinge 228 comprising a rod 229 which protrudes through corresponding mounting holes 230 which are provided within the case 203 and within the insert 205. The hinge 228 movably attaches the cap 207 to the case 203. The cap 207 comprises a portion 231 with a tapered surface 232 that slides along the surface of the pin 226 when the child-resistant smoking article package 200 is transferred from an opened state to a closed state or from a closed state to an opened state. Furthermore, in this second embodiment of the invention, the insert 205 exemplarily and optionally provides a holding 220 for a leaflet 221 that can be inserted into the holding 220 and a location hole 219 for a smoking article 202 that can be inserted into the location hole 219.

In FIG. 5*a*, the second embodiment of the child-resistant smoking article package 200 is shown in a closed state. In this closed state, the spring system 218 of the snap-action mechanism 233 exerts a force on the cap 207 and keeps the child-resistant smoking article package 200 closed. When the first, second and third releaseably engageable fixation members 208-1, 208-2 and 208-3 are actuated simultaneously, the child-resistant smoking article package 200 can be transferred from the closed state to an opened state, which is shown in FIGS. 5*b* and 5*c*. In FIG. 5*b* and FIG. 5*c*, the retaining lugs 216-1, 216-2, 216-3 of the snap-action connections 215 of the first, second and third releaseably engageable fixation members 208-1, 208-2, 208-3 are detached from their corresponding fixation holes 217-1, 217-2, 217-3.

In FIGS. 4*a* and 5*a*, a detailed view denoted by Z of the first releaseably engageable fixation member 208-1 of the second embodiment is shown. In more detail, the detailed view denoted Z shows the first retaining lug 216-1 of the first releaseably engageable fixation member 208-1 which forms a part of the arm section 210 of the cap 207. The first retaining lug 216-1 is engaged with the first fixation edge 217-1 of the first releaseably engageable fixation member 208-1. The first fixation edge 217-1 is provided by a retaining bracket 213. The retaining bracket 213 is strapped around a part of the circumference of the case 203 of the second embodiment of the child-resistant smoking article package 200. For an engagement of the first retaining lug 216-1 with the first fixation edge 217-1, the arm section 210 of the cap 207 with the first retaining lug 216-1 thereon is guided through the gap between the case 203 and the retaining bracket 213 until the first retaining lug 216-1 snaps under the first fixation edge 217-1.

Figure 6:
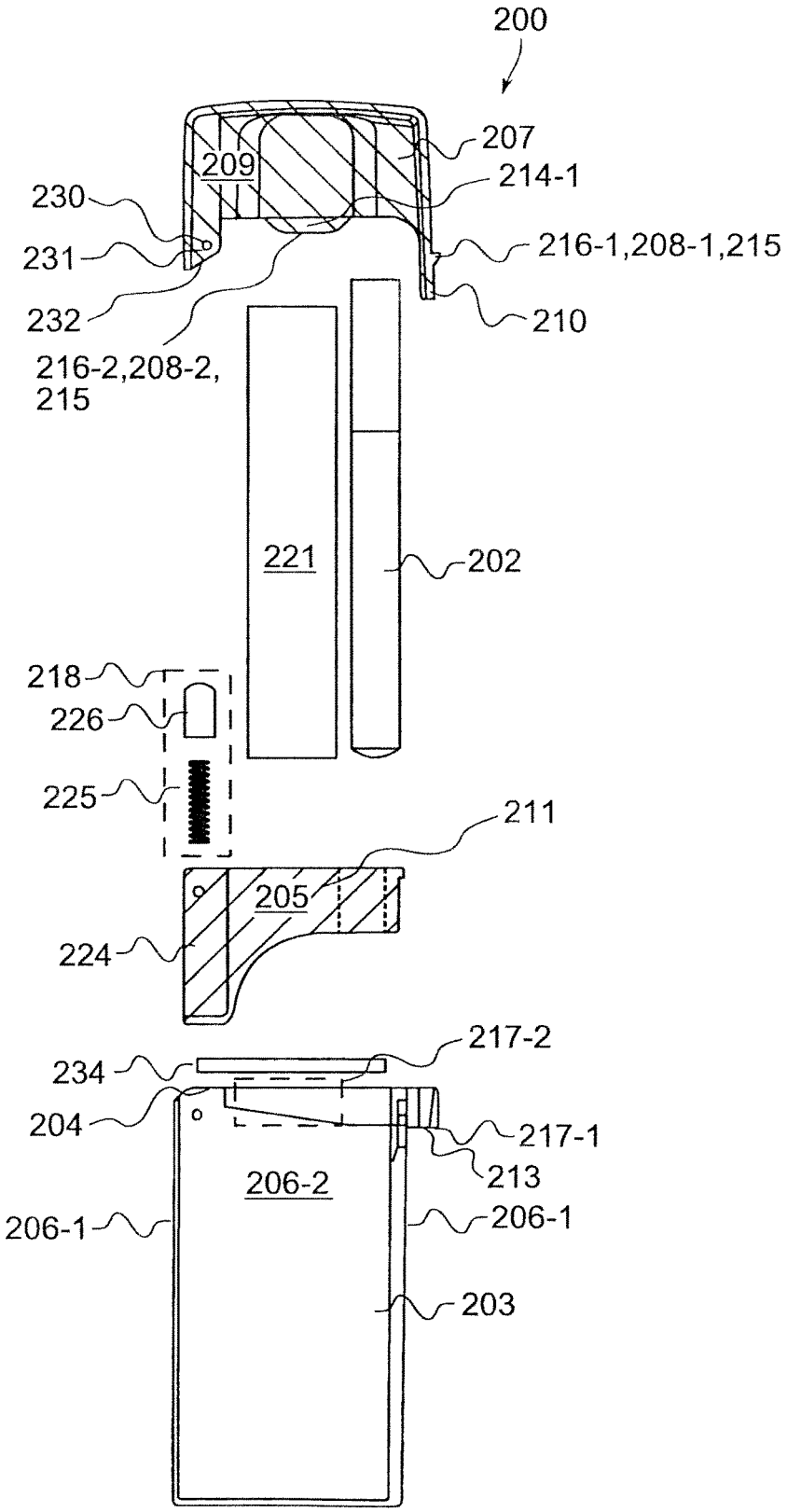

FIG. 6 shows an exploded view of the second embodiment of a child-resistant smoking article package 200 according to the invention. The components of FIG. 6 with reference signs which are identical to the respective reference signs shown in FIG. 4*a* to FIG. 5*c* will not be described explicitly hereinafter. However, the description related to these components is also applicable to the components with identical reference signs shown in FIG. 6. Furthermore, the second embodiment shown in FIG. 6 is substantially identical to the first embodiment of the child-resistant smoking article package 100 as shown in FIG. 1*a* to FIG. 1*c*, FIG. 2*a* to FIG. 2*c* and FIG. 3 and as described hereinbefore. However, some of the components differ as will now be described hereinafter.

The second embodiment of the invention also comprises a case 203 which is substantially identical to the case 103 as shown in FIG. 3 and as described hereinbefore. In contrary to the first embodiment of the invention, the second embodiment of the child-resistant smoking article package 200 comprises a retaining bracket 213 which is attached to the case 203 and which provides a first fixation edge 217-1 for a first retaining lug 217-1. Also in this second embodiment, a foam sticker 234 can be arranged within the case 203. Furthermore, a smoking article 202 and a leaflet 221 are shown in FIG. 6. In the second embodiment of the invention, the insert 205 only comprises a body section 211 and has no spring arm section 112 and no first or second insert protrusions 123-1, 123-2. When the child-resistant smoking article package 200 is assembled, the insert 205 is enclosed by the opening 204 of the case 203. The cap 207 of the second embodiment of the invention also differs from the cap 107 of the first embodiment of the child-resistant smoking article package 100. The cap 207 comprises a base section 209 and an arm section 210 which extends from the base section 209 along a direction which is parallel to the narrow sides 206-1 of the case 203 when the second embodiment of the child-resistant smoking article package 200 is assembled and closed. Furthermore, the cap 207 comprises a portion 231 with a tapered surface 232 and mounting holes 230 therein. In this second embodiment of the invention, a first retaining lug 216-1 is arranged on the arm section 210 of the cap 203. The first retaining lug 216-1 corresponds to the first fixation edge 217-1 provided by the retaining bracket 213. In a closed state of the assembled child-resistant smoking article package 200, the first retaining lug 216-1 is releaseably engaged with the first fixation edge 217-1 provided by the retaining bracket 213.

In this second embodiment of the invention, the base section 209 of the cap 203 comprises a first and a second protrusion 214-1, 214-2 arranged on opposing sides of the base section 209 of the cap 203 and extending towards the bottom of the case 203 when the child-resistant smoking article package 200 is assembled and closed. In FIG. 6, only the second protrusion 214-2 is visible. A second retaining lug 216-2 is arranged on the first protrusion 214-1 of the base section 209, wherein a third retaining lug 216-3 is arranged on the second protrusion 214-2 of the base section 209. A second and third fixation hole 217-2, 217-3 are arranged within the long sides 206-2 of the case 203, wherein only the position of the second fixation hole 217-2 is indicated in FIG. 6. The second fixation hole 217-2 corresponds to the second retaining lug 216-2. The third fixation hole 217-3 corresponds to the third retaining lug 216-3. In a closed state of the assembled child-resistant smoking article package 200, the first retaining lug 216-1 is releaseably engaged with the first fixation hole 217-1, the second retaining lug 216-2 is releaseably engaged with the second fixation hole 217-2 and the third retaining lug 216-3 is releaseably engaged with the third fixation hole 217-3.

As already stated, the first and second embodiment of the child-resistant smoking article package 200 described above both comprise the same snap-action mechanism 233 which furthermore has the same function in both embodiments. However, the invention is not limited thereto and it is also possible to realize embodiments of child-resistant smoking article packages 200 according to the invention with other snap-action mechanisms 233 that have other functions as described above. Furthermore, it is also possible to realize embodiments of child-resistant smoking article packages 200 according to the invention that do not comprise a snap-action mechanism 233, so without any spring system 218 or hinge 218.

Moreover, the first, second and third releaseably engageable fixation members 208-1, 208-2, 208-3 of the first and second embodiment are realized as snap-action connections 215. However, the invention is not limited thereto and it is possible to realize embodiments of child-resistant smoking article packages 200 according to the invention without any snap-action connections 215, so with first, second and third releaseably engageable fixation members 208-1, 208-2, 208-3 that are realized as other connections or means for a releaseably engageable connection. Furthermore, it is also possible to realize embodiments of child-resistant smoking article packages 200 according to the invention which comprise different combinations of releaseably engageable fixation members 208-1, 208-2, 208-3 of the first and second embodiment. For example, it is possible to combine the realization of the first releaseably engageable fixation member 208-1 of the first embodiment with the realization of the second and third releaseably engageable fixation members 208-2, 208-3 of the second embodiment within another embodiment. Furthermore, a retaining lug 116, 216 can be a first retaining lug 116-1, 216-1, a second retaining lug 116-2, 216-2, a third retaining lug 116-3, 216-3 or any further retaining lug 116, 216. Moreover, a fixation hole or fixation edge 117, 217 can be a first fixation hole or fixation edge 117-1, 217-1, a second fixation hole or fixation edge 117-2, 217-2, a third fixation hole or fixation edge 117-3, 217-3 or any further fixation hole or fixation edge 1117, 217.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

100, 200 child-resistant smoking article package
102, 202 smoking article
103, 203 case
104, 204 opening
105, 205 insert
106-1, 206-1 narrow side
106-2, 206-2 long side
107, 207 cap
108-1, 208-1 first releaseably engageable fixation member
108-2, 208-2 second releaseably engageable fixation member
108-3, 208-3 third releaseably engageable fixation member
109, 209 base section
110, 210 arm section
111, 211 body section
112 spring arm section
213 a retaining bracket
214-1 first protrusion
214-2 second protrusion
115, 215 snap-action connection
116, 216 retaining lug
116-1, 216-1 first retaining lug
116-2, 216-2 second retaining lug
116-3, 216-3 third retaining lug
117, 217 fixation hole, fixation edge
117-1, 217-1 first fixation hole, fixation edge
117-2, 217-2 second fixation hole, fixation edge
117-3, 217-3 third fixation hole, fixation edge
118, 218 spring system
119, 219 location hole
120, 220 holding
121, 221 leaflet
122, 222 actuation area
123-1 first insert protrusion
123-2 second insert protrusion
124, 224 cavity
125, 225 spring
126, 226 pin
128, 228 hinge
129, 229 rod
130, 230 mounting holes
131, 231 portion
132, 232 tapered surface
133, 233 snap-action mechanism
134, 234 foam sticker

The invention claimed is:

1. Child-resistant smoking article package (100), comprising:

a case (103) with an opening (104) adapted to receive a smoking article (102), a cap (107) movable between a closed state wherein the cap (107) closes the case (103) and an open state wherein the opening (104) of the case (103) is accessible, a first (108-1), second (108-2) and third (108-3) releaseably engageable fixation member, wherein the second and third releaseably engageable fixation members (108-2, 108-3) are arranged on opposing sides of the child-resistant smoking article package (100) and wherein the first, second and third releaseably engageable fixation members (108-1, 108-2, 108-3) are adapted to fix the cap (107) to the case (103) in the closed state and to release the cap (107) when simultaneously actuated, wherein the case (103) further comprises an insert (105) which is fixed within the case (103), wherein the insert (105) comprises a body section (111) and a spring arm section (112), wherein the body section (111) is enclosed by the opening (104) and wherein the spring arm section (112) extends from the body section (111) along an arm section (110) of the cap (107);

wherein the first and/or the second and/or the third releaseably engageable fixation members (108-1, 108-2, 108-3) are realized as snap-action connections (115), the snap-action connections (115) each comprise a retaining lug (116) and a corresponding fixation hole or fixation edge (117); and wherein the spring arm section (112) comprises a freestanding actuation area (122) adjacent to the snap connection (115), the freestanding actuation area (122) configured to push or pull the spring arm section (112) towards the case (103) so as to detach the retaining lug (116) from the corresponding fixation hole or fixation edge (117).

2. Child-resistant smoking article package (100) of claim 1, wherein the cap (107) comprises a base section (109) and the arm section (110), wherein the arm section (110) extends from the base section (109) along a direction that is parallel to the height of the case (103) in the closed state of the child-resistant smoking article package (100).

3. Child-resistant smoking article package (100) of claim 2, wherein the body section (111) of the insert (105) or the base section (109) of the cap (107) comprises the second and/or the third releaseably engageable fixation member (108-2, 108-3), adapted to detachably fix the body section (111) of the insert (105) and the base section (109) of the cap (107) to one another.

4. Child-resistant smoking article package (100) of claim 2 wherein the retaining lug (116-2) of the second and/or the third releaseably engageable fixation member (108-2, 108-3) is arranged on the body section (111) of the insert (105) or on the base section (109) of the cap (107) and wherein the respective corresponding fixation hole or fixation edge (117) is arranged on the base section (109) of the cap (107) or on the body section (111) of the insert (105).

5. Child-resistant smoking article package (100) of claim 1, wherein the first releaseably engageable fixation member (108-1) is arranged on the spring arm section (112) of the insert (105) or on the arm section (110) of the cap (107) and is adapted to detachably fix the spring arm section (112) of the insert (105) and the arm section (110) of the cap (107) to one another.

6. Child-resistant smoking article package (100) of claim 1, wherein the first releaseably engageable fixation member (108-1) and the second and/or third releaseably engageable fixation member (108-2, 108-3) are arranged on sides of the child-resistant smoking article package (100) which are perpendicular to one another.

7. Child-resistant smoking article package (100) of claim 1, wherein the retaining lug (116-1) of the first releaseably engageable fixation member (108-1) is arranged on the spring arm section (112) of the insert (105) or on the arm section (110) of the cap (107) and wherein the corresponding fixation hole or fixation edge (117-1) is arranged on the arm section (110) of the cap (107) or on the spring arm section (112) of the insert (105).

8. Child-resistant smoking article package (100) of claim 1, further comprising a spring system (118) which is adapted to exert a force on the cap (107) in order to maintain the child-resistant smoking article package (100) in a closed state.

9. Child-resistant smoking article package (100) of claim 1, wherein the spring arm section (112) of the insert (105) is biased against the arm section (110) of the cap (107) in the closed state of the child-resistant smoking article package (100).

* * * * *